US005842812A

United States Patent [19]

Carey

[11] Patent Number: 5,842,812

[45] Date of Patent: Dec. 1, 1998

[54] TYPE OF FLEXIBLE MAT FOR LINING EMBANKMENTS

[75] Inventor: Frank Carey, Beenleigh, Australia

[73] Assignee: Revetment Systems Australia (QLD) PTY Ltd., Beenleigh, Australia

[21] Appl. No.: 776,022

[22] PCT Filed: Jul. 18, 1995

[86] PCT No.: PCT/AU95/00431

§ 371 Date: Jan. 21, 1997

§ 102(e) Date: Jan. 21, 1997

[87] PCT Pub. No.: WO96/03550

PCT Pub. Date: Feb. 8, 1996

[51] Int. Cl.[6] ..... E02B 3/12

[52] U.S. Cl. ..... 405/18; 405/19; 405/20

[58] Field of Search ..... 405/18, 19, 20

[56] References Cited

U.S. PATENT DOCUMENTS

| | | | |
|---|---|---|---|
| 3,474,626 | 10/1969 | Colle | 405/18 |
| 3,561,219 | 2/1971 | Nishizawa et al. | 405/19 |
| 3,696,623 | 10/1972 | Heine et al. | 405/19 |
| 4,102,137 | 7/1978 | Porraz et al. | 405/18 |
| 4,184,788 | 1/1980 | Colle | 405/19 |
| 4,375,928 | 3/1983 | Crow et al. | 405/18 |
| 4,405,257 | 9/1983 | Nielsen | 405/19 |
| 4,449,847 | 5/1984 | Scales et al. | 405/19 |
| 4,502,815 | 3/1985 | Scales et al. | 405/17 |
| 4,592,675 | 6/1986 | Scales et al. | 405/19 |
| 4,693,632 | 9/1987 | Ingersoll | 405/18 |

FOREIGN PATENT DOCUMENTS

| | | |
|---|---|---|
| B87802/91 | 5/1992 | Australia . |
| 0190039 | 8/1986 | European Pat. Off. . |
| 1780545 | 12/1992 | U.S.S.R. . |
| 2207168 | 1/1989 | United Kingdom . |

*Primary Examiner*—David J. Bagnell
*Assistant Examiner*—Gary S. Hartmann
*Attorney, Agent, or Firm*—Rodman & Rodman

[57] ABSTRACT

A body having an interior with a plurality of chambers, a plurality of fracture zones and a plurality of filter zones which permit water to pass through opposing exterior surfaces of the body, in use the body interior being arranged to receive a substance which hardens on drying and fractures at locations defined by the fracture zones.

26 Claims, 12 Drawing Sheets

TYPE OF FLEXIBLE MAT FOR LINING EMBANKMENTS

FIELD OF THE INVENTION

The present invention relates to revetment systems and is particularly concerned with providing a method of facing embankments such as drainage causeways.

BACKGROUND OF THE INVENTION

Typically the construction of a drainage causeway involves the digging of channel and subsequently the revegetation of the surrounding embankment. The problem with the revegetation procedure is that it takes time for this to occur and in the meantime soil erosion can occur with accompanying degradation of the causeway embankment.

For this reason revetment systems have been utilised and a typical one of these involves the use of concrete bedding which is laid along the embankment, such bedding can be formed by filling a mat with concrete and letting it set. Although this system is an improvement on those which require preformed concrete structures, it still suffers from the problem that once the concrete mat has set it cannot be manipulated, that is bent or folded in any manner so as to adapt the mat to the contours of the embankment on which it is to be used. Thus the mat must be either placed in its desired orientation prior to filling with concrete, or if it is moved, once it is set in a particular configuration the soil of the embankment must be moved to adapt it to the shape of the mat.

SUMMARY OF THE INVENTION

According to the present invention a body is provided having an interior with a plurality of chambers, a plurality of fracture zones and a plurality of filter zones which permit water to pass through opposing exterior surfaces of the body, in use the body interior being arranged to receive a substance which hardens on drying arid fractures at locations defined by the fracture zones.

It is preferred that the body has a plurality of openings interconnecting respective chambers.

The openings may have side barrier portions with respective apex portions arranged opposite each other and defining the fracture zones For creating fractures in setting cement which is to fill the chambers.

Preferably the fracture zones create fractures in a settable substance which is arranged to be pumped into the interior of the body, and the fractures serve to create hardened substance portions in the respective chambers.

Preferably the substance portions created in adjacent chambers are movable with respect to each other.

It is preferred that the fractures which are created in the substance enable the body to be flexible or bendable so that it may be reconfigured to different shapes.

It is preferred that each side barrier portion comprises adjacent straight walls which meet at an apex.

Each chamber may have a plurality of openings.

Each chamber may be defined by a Plurality of boundary portions.

Preferably each boundary portion comprises respective end portions.

Opposing end portions of different boundary portions may be arranged to define an opening.

Each end portion preferably includes a side barrier portion.

Each chamber may have boundary portions which substantially surround an interior portion of the chamber.

Preferably the boundary portions form respective corners of the interior of the chamber.

The boundary portions may comprise two corner portions which extend at an acute angle with respect to each other.

The corner portions may extend at substantially 90° with respect to each other.

It is preferred that the boundary portions of each chamber form a rectangular enclosure forming the walls of the chamber.

Each chamber may comprise four openings.

It is preferred that each opening for a chamber is located in a side of the object formed by the boundary portions of that chamber.

Each opening may be formed inside of the rectangular enclosure forming the walls of each chamber.

It is preferred that each opening is formed substantially midway along each side of the object formed by the boundary portions.

Each opening may be formed substantially midway along each side of the rectangular enclosure forming the walls of each chamber.

Desirably each opening is located between each corner of each chamber

Each boundary portion may be arcuate in shape.

Each boundary portion may be V-shaped.

Preferably each boundary portion includes a straight section.

Each boundary portion may have an end portion which is co-linear or co-axial with the end portion of another boundary portion separated therefrom by at least one opening.

Each opening may be defined by opposing end portions of separate barrier portions.

Each end portion preferably comprises side portions which converge to an apex.

The shortest distance across an opening may be measured between the apex of opposing end portions of separate boundary portions.

Preferably each apex comprises a corner formed where the converging side portions meet.

Each apex may terminate in a point.

Preferably the opposing end portions of boundary portions are symmetrical about a centre line through the opening between the opposing end portions.

Each end portion may comprise lateral portions.

According to one embodiment each boundary portion comprises an elongate portion which terminates at an opening end in one end portion.

Preferably the elongate portion has a central longitudinal axis with the apex portion being located at its tip.

The elongate portion may comprise lateral portions on either side of the central longitudinal axis.

The lateral portions may be arranged symmetrically about the central longitudinal axis.

Preferably a plurality of lateral portions are provided on either side of the central longitudinal axis.

Each lateral portion may comprise first and second side walls which meet to form a point.

The first and second portions preferably form an angle of 90°.

Preferably each lateral portion is wedge shaped.

The lateral portions may form serrations on each side of the central longitudinal axis.

Preferably each elongate portion extends from a central portion.

Each central portion preferably has elongate portions which radiate therefrom.

According to one embodiment of the invention the central portion has a plurality of boundary portions extending therefrom.

Preferably the central portion has two boundary portions extending therefrom.

Preferably each boundary portion comprises two elongate portions.

Each elongate portion may extend at 90° to an adjacent one.

Preferably each elongate portion extends from a corner portion of the central portion.

Each elongate portion is preferably symmetric with an adjacent elongate portion about a central dividing line.

Each elongate portion may be substantially identical to adjacent elongate portions.

Preferably each boundary portion is substantially identical.

Each central portion may have four elongate portions arranged in a cross-configuration.

Preferably the central longitudinal axis of elongate portions with opposing end portions are co-linear.

Each elongate portion may comprise lower lateral portions which form a recess with a section of the central portion.

Preferably the recess has a rectangular shape.

Each elongate portion may have a lateral portion with the same maximum width.

Adjacent lateral portions may have wall portions which meet at 90°.

The width of regions between adjacent lateral portions may be substantially the same.

Preferably each elongate portion includes a filter zone which permits water to pass therethrough.

Each boundary portion may be formed by connecting together upper and lower surfaces of the body.

Preferably the body comprises a flexible material.

The body may comprise a woven material which may be a fabric.

The body may be porous.

Each central portion may be porous.

Preferably each chamber is circular with a plurality of openings.

Each chamber may be arranged to be filled with a flexible material which hardens when dried.

The body comprises an upper and lower surface of woven fabric.

It is preferred that the boundaries are formed by weaving together upper and lower surfaces of the body.

The chambers may be annular in shape.

Preferably the chambers are X-shaped.

Alternatively the chambers are square shaped.

It is preferred that the body portion comprises an inlet which is connected to one of the chambers In use the body may be arranged to be filled with wet cement.

When the cement dries it is preferred that fractures occur across the openings.

When the cement dries it is preferred that discontinuities occur across the openings. Preferably the body when filled with wet cement is arranged to be flexible.

The material filled into the chambers may be arranged to be fractured during drying as a result of the configuration of end portions defining each opening.

Preferably the fracture zones are defined by opposing end portions of elongate portions.

Preferably each chamber when filled with a set hardened material is arranged to be movable with respect to an adjacent chamber.

Preferably the body comprises a series of annular chambers and X-shaped filter zones.

Each annular chamber may comprise a central filter zone.

Preferably each opening is defined by opposing end portions which are configured to cause a fracture in cement as it sets.

Preferably the end portions each end in a point.

The distance between end portions is preferably 80 mm.

The length of each elongate portion when measured along its central longitudinal axis to the centre of the central portion is preferably 172.5 mm.

Preferably the length of two co-linear elongate portions and the interconnecting central portion measured along their central longitudinal axes is 345 mm.

The distance between adjacent end portion apexes is preferably 246 mm.

Preferably the distance between opposing end portion apexes is 80 mm.

Preferably each chamber has a central barrier zone.

The barrier zone may be porous.

Preferably each central boundary portion has corner portions with the apex of the corners facing respective openings of the chamber in which it is located.

Preferably the boundary portions are formed by weaving, bonding, stitching, gluing or some other method for connecting upper and lower surfaces of the body.

Preferably the distance between the apex of one of the corners of the central boundary portion is located approximately 190 mm from the centre point of a line drawn between the apexes of opposing end portions.

Preferably the central boundary portions have side walls which are co-linear with parallel lower lateral portions of adjacent recesses.

Preferably the recesses are T-shaped and the head of the T matches the shape of the opposing sides of the central boundary portion.

BRIEF DESCRIPTION OF THE DRAWINGS

A preferred embodiment of the present invention will now be described by way of example only with reference to the accompanying drawings in which.

DESCRIPTION OF THE PREFERRED EMBODIMENTS

Figure 1:
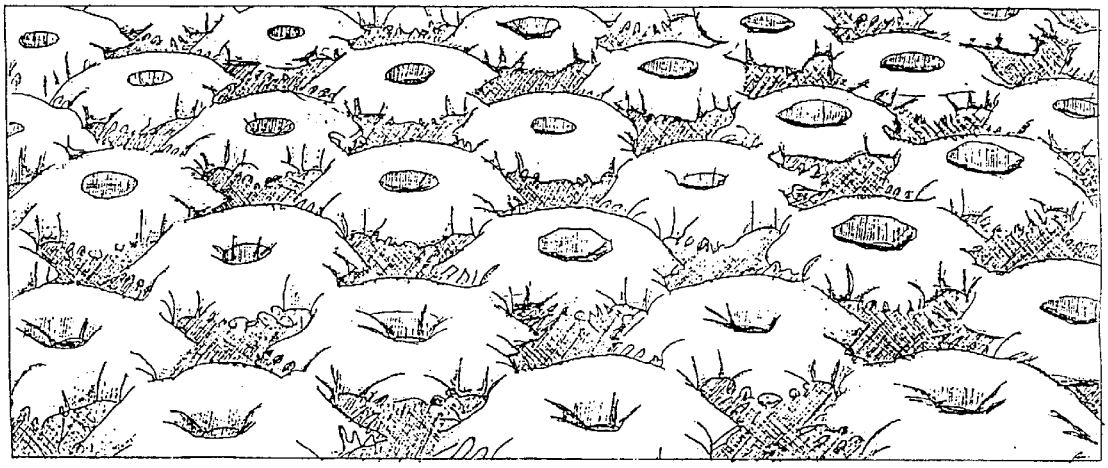
FIG. 1 shows a revetment mat of a first embodiment of the present invention when filled with concrete.

The photograph of the revetment mat 10 shown in FIG. 1 shows inflated annular compartments 11 filled with concrete, cross shaped woven portions 12 and central woven portions 13 located inside the annular chambers 11.

The woven portions 12 and 13 are porous and allow water to pass through the mat from the upper to the lower surface. Because these woven portions 12 and 13 connect the upper and lower surfaces of the mat together they serve to define the chambers 11 and confine the concrete which is pumped into the mat to the interior of the respective chambers.

Figure 2:
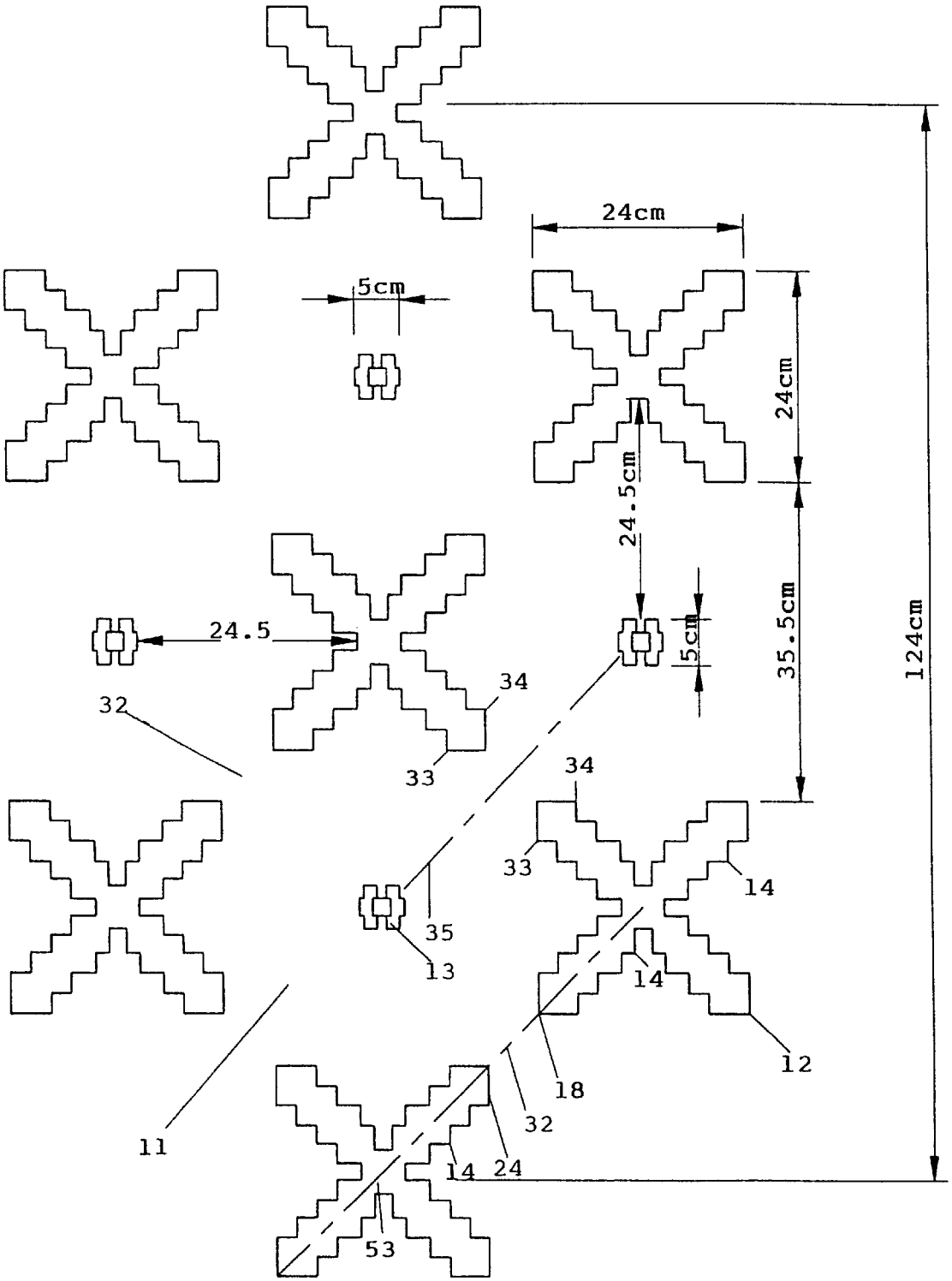
FIG. 2 shows a schematic diagram of a top surface of the mat of FIG. 1 and the stitching pattern for connecting upper and lower surfaces of the mat.

As shown in FIG. 2 the mat has a repetitive configuration of chambers 11, cross shaped woven portions 12 and central woven portions 13. A chamber 11 is formed by four of the crosses 12 which are arranged in a square configuration at the respective corners of the square.

Openings 32 are located between opposing legs of the crosses 12.

Figure 3:
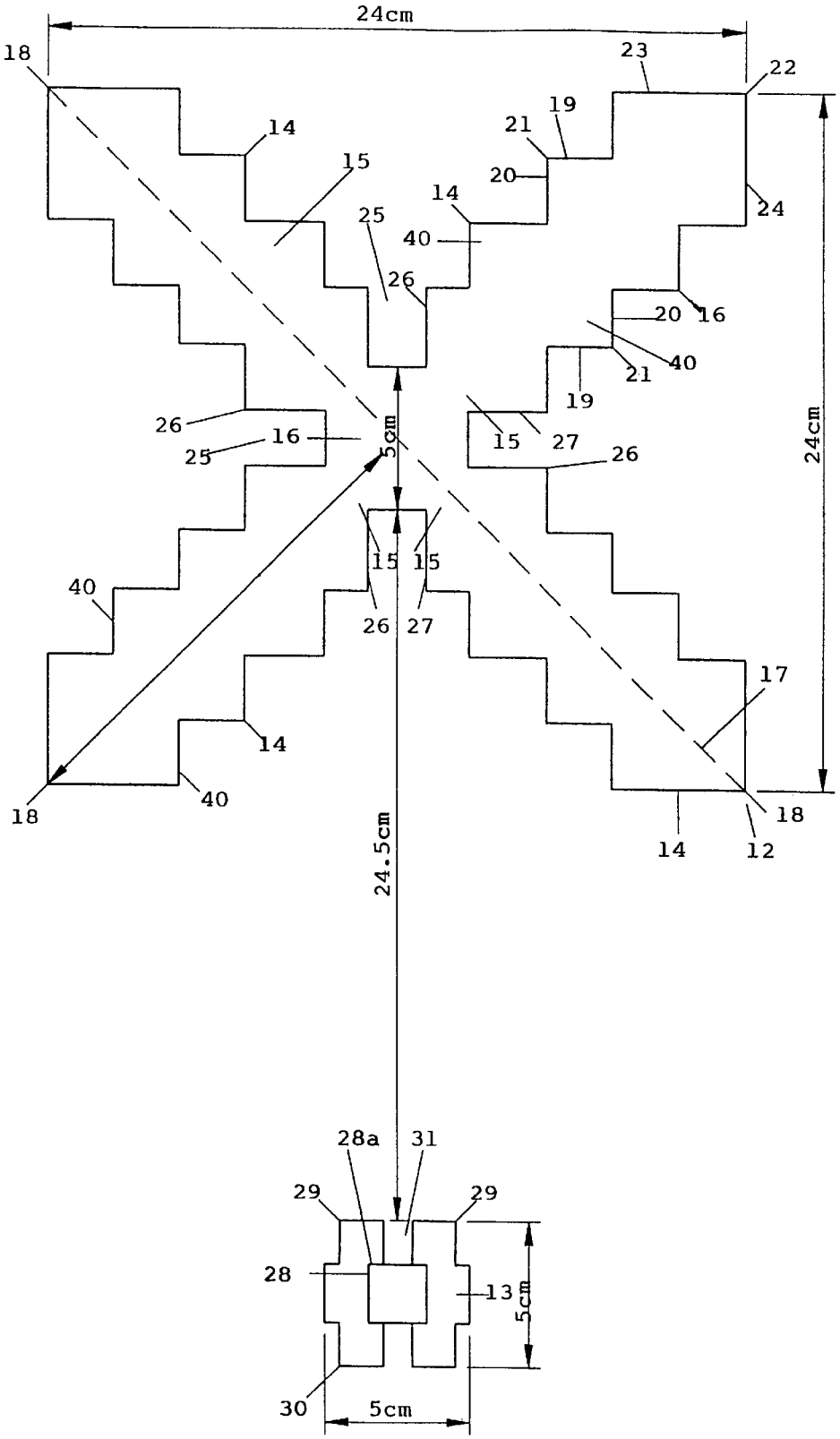
FIG. 3 shows a top view of the cross shaped pattern formed by the weaving.
Figure 4:
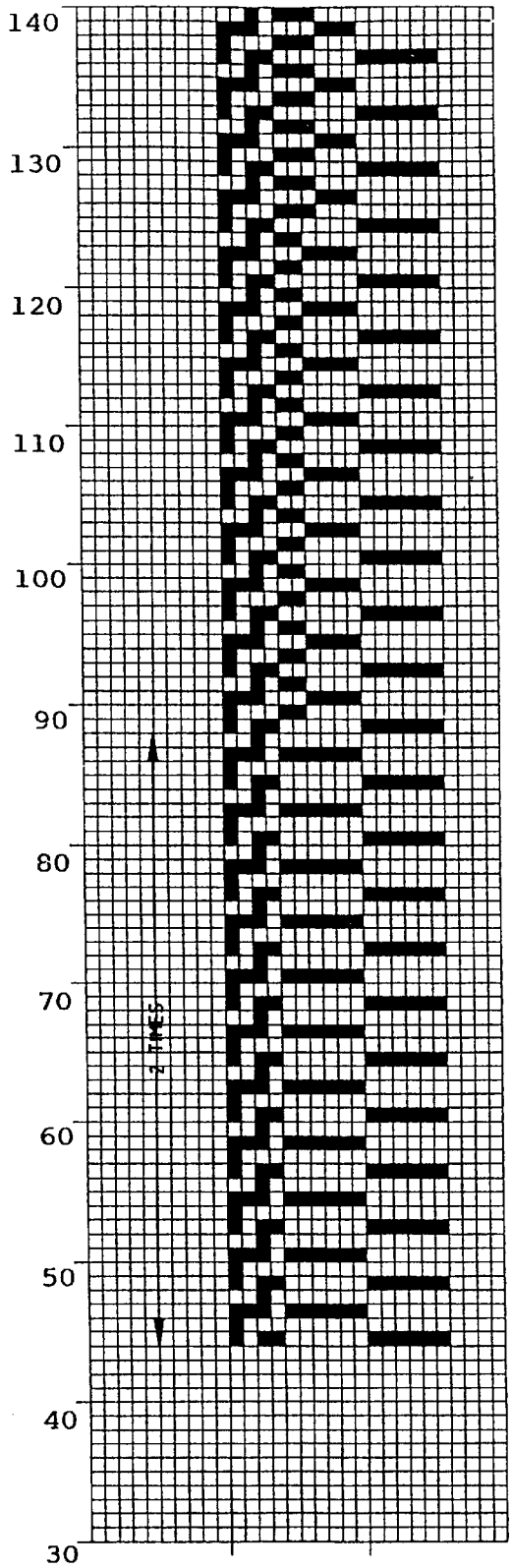
FIGS. 4 to 12 show diagrams of peg plans for a mat woven according to the first embodiment.
Figure 5:
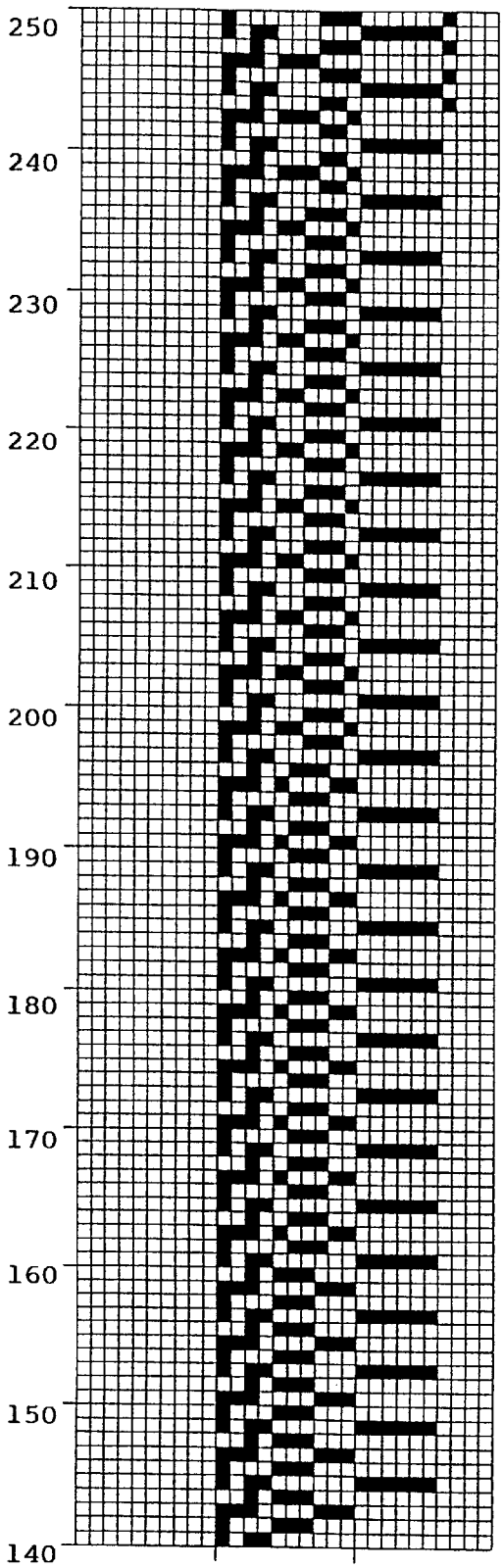
Figure 6:
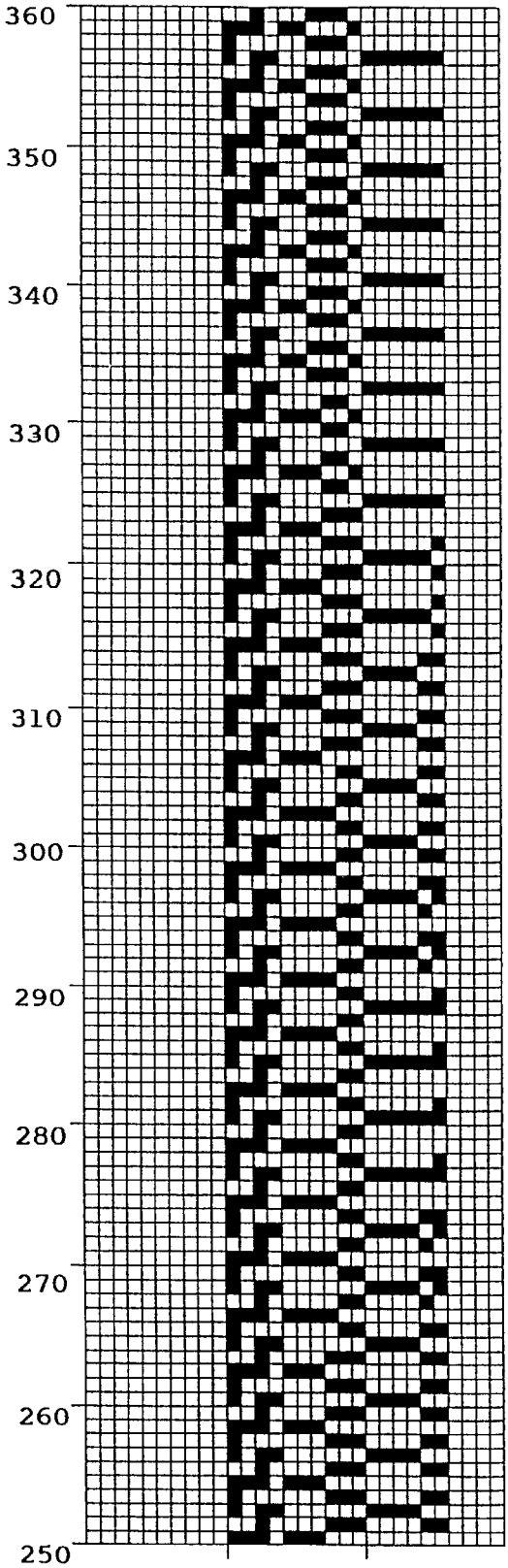
Figure 7:
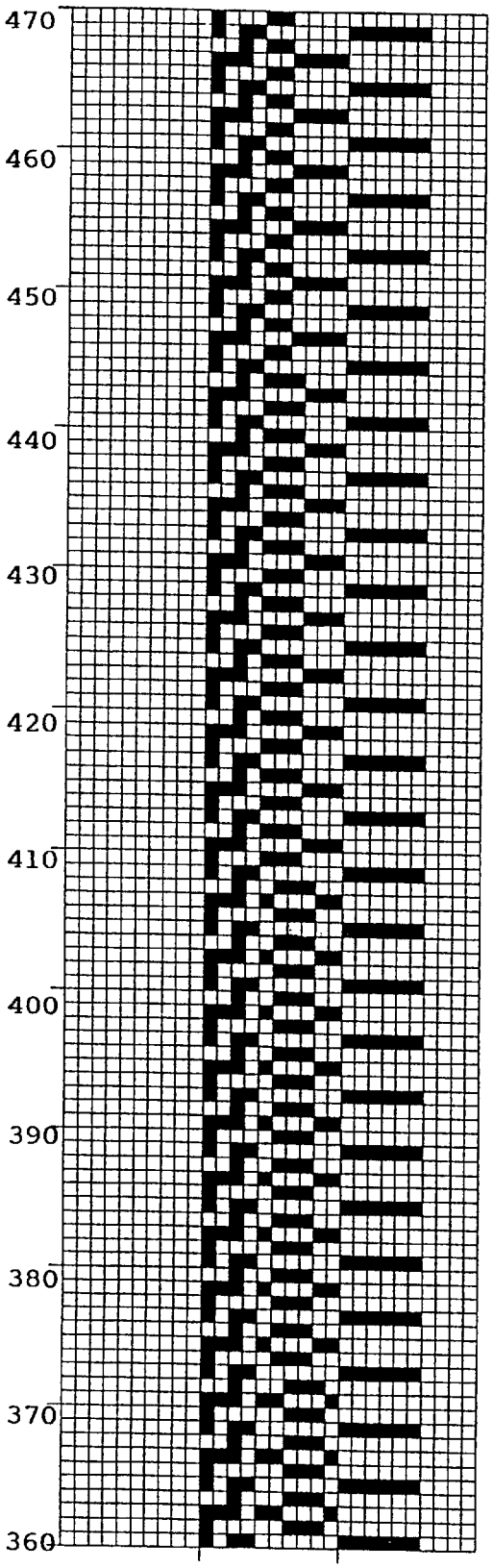
Figure 8:
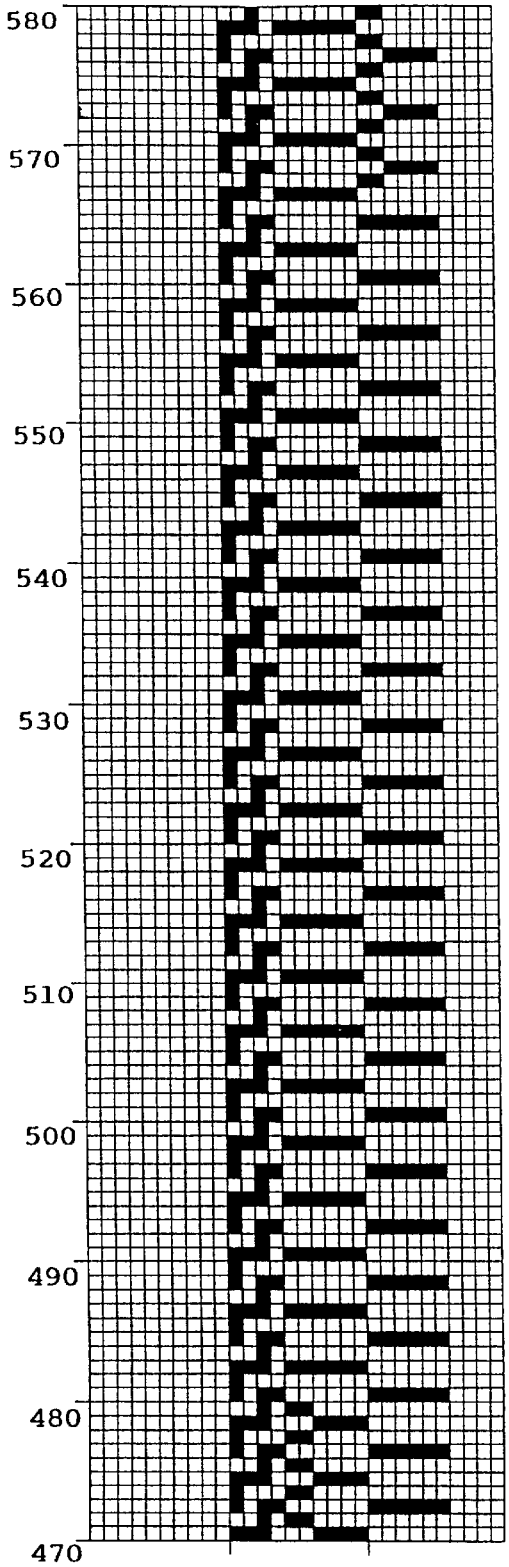
Figure 9:
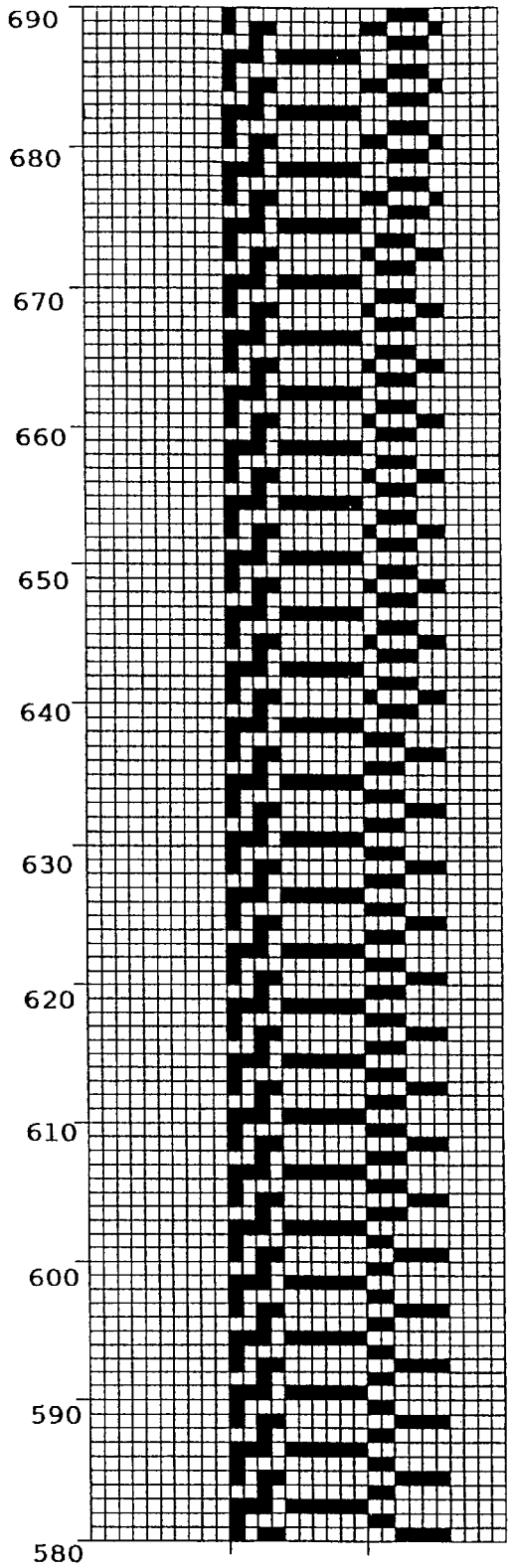
Figure 10:
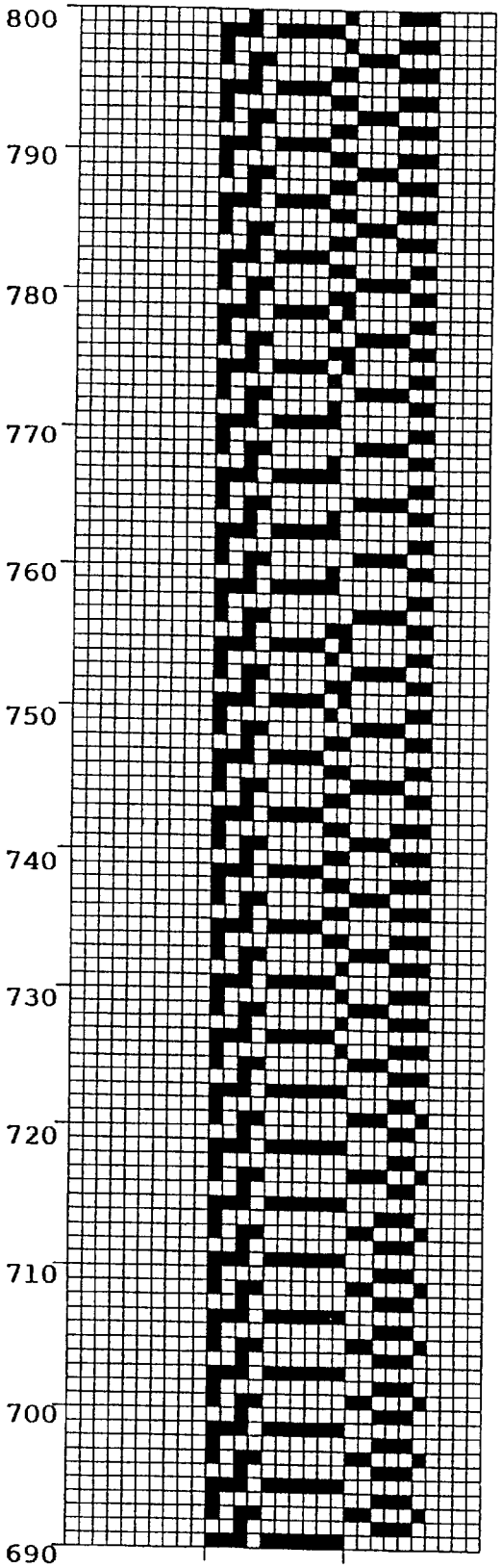
Figure 11:
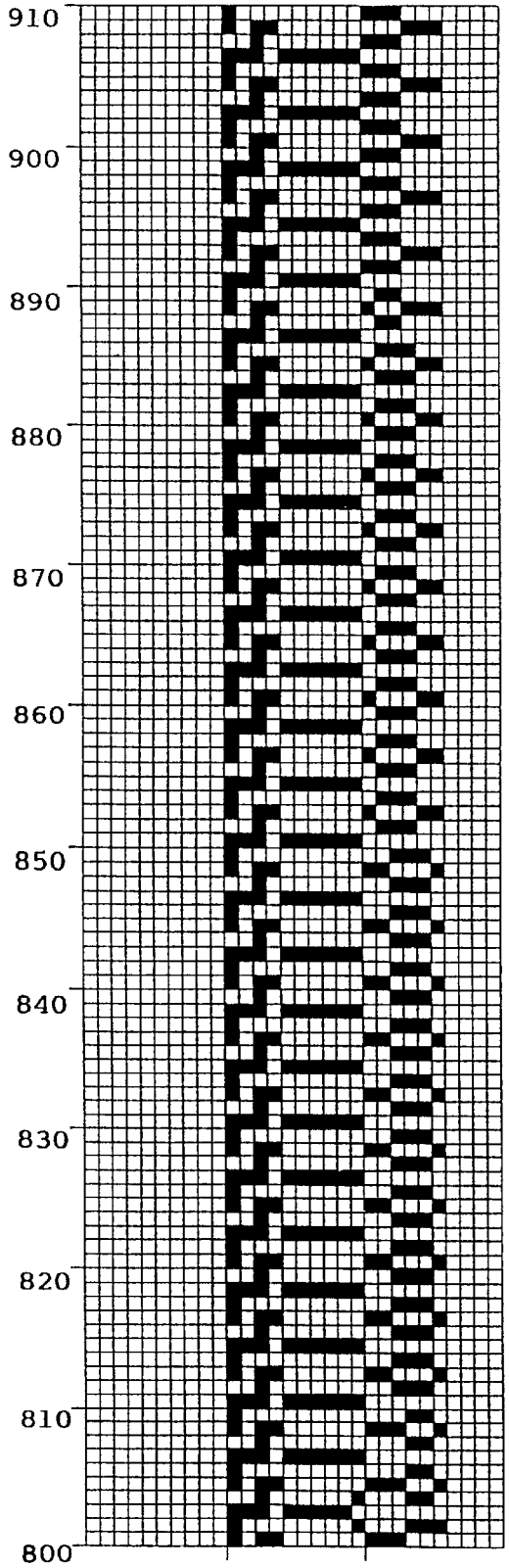
Figure 12:
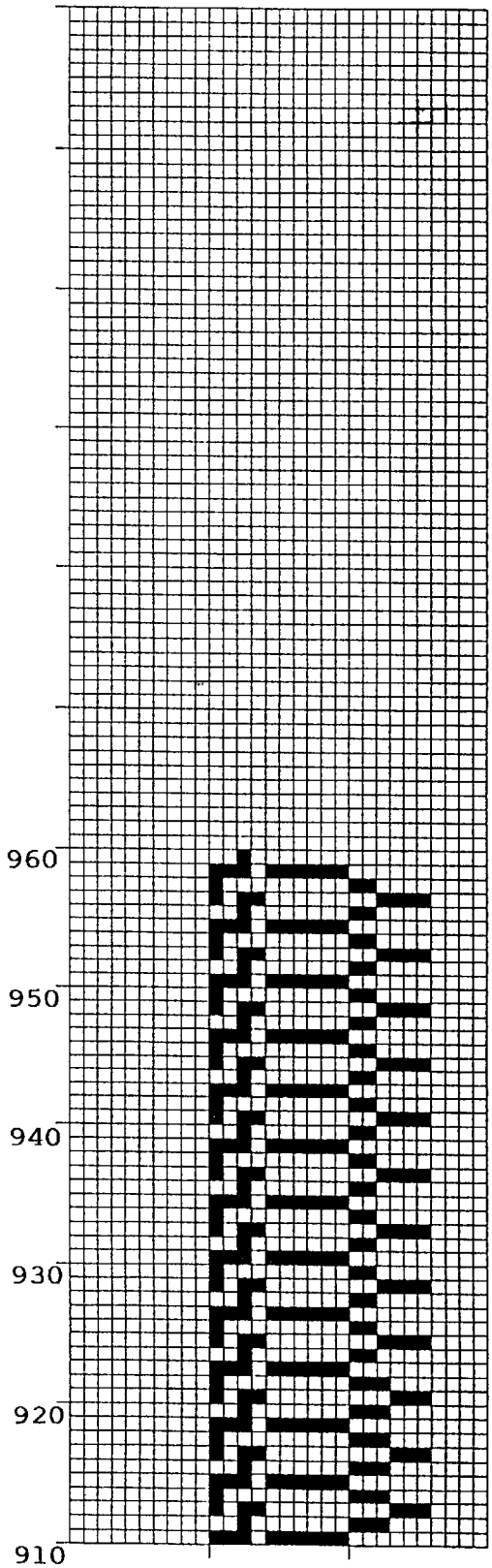

As shown in FIG. 3 each cross consists of four legs 14 which extend from the corners 15 of a central rectangular portion 16 which has a width of 5 cm.

Each of the legs 14 of the cross 12 has serrated sides 40 which are symmetric about a central longitudinal axis 17 which extends between the tips of the legs 14 which have the same central longitudinal axis 17.

The serrations 40 are formed by a number of straight sections 19 and 20 which meet at right angles to form the tip 21 of a tooth. At each end of the legs 14, the cross terminates in a point 22 formed by end walls 23 and 24 meeting at right angles. Each of the side walls 19,20 of the serrations 40 are parallel to corresponding side walls 19,20 of serrations 40 on the same leg 14 of the cross 12 and those of corresponding side walls on the other legs 14 of the cross 12.

Thus according to FIGS. 2 and 3 each of the side walls 20 are vertical and side walls 19 are horizontal.

At the central portion end of each leg the side walls 26, 27 which branch out from the corners 15 of central portion 16 and form a recess 25 with adjacent side walls 26, 27 of adjacent legs of the cross.

In fact two adjacent legs 14 of one cross 12 form a series of stepped recesses which are symmetric about a centre line drawn midway through the central portion 16 and recesses 25 and which divides the cross in half between adjacent legs 14.

As shown in FIG. 3 each leg 14 has four serrations 40 on each side of the axis 17 and is substantially identical to the other legs 14 of the cross 12.

The dimensions of the crosses 12 are provided in FIG. 3 and as shown, from the apex 18 of one leg to the apex 18 of an adjacent leg of the same cross the distance is 24 cm. The distance from an apex of one leg to the centre of the central portion 16 is 17 cm.

Each central woven portion 13 has an internal square section 28 which is sandwiched between two rectangular portions 29 each having a rectangular recess 28*a* to receive a part of the internal square section and each having a rectangular shaped portion 30 extending from its longest side away from the internal square section 28 and of a matching configuration to the recess 28*a* which receives a part of the square section 28. A recess 31 is formed on either side of the square section 28 between the rectangular portions 29 A centre line drawn through the square section 28 and dividing the sandwich in half is co-linear with a central dividing line drawn through the central portion 16 of the cross and both sides of the central woven portion as well as both sides of the cross are symmetric about this centre line.

The distance from the edge of the central woven portion 13 along the central dividing line to the central portion 16 of the cross is 24.5 cm.

As shown in FIG. 2 the central woven portion 13 is oriented so that its faces are parallel to opposite facing sides of adjacent crosses. Thus overall all sides are arranged in one of two orientations, both orientations being 90° to each other.

According to the preferred embodiment the distance across an opening from one apex to an opposing apex is 7 cm, whereas the distance between parallel legs of different but adjacent crosses is approximately 30 cm.

The ratio of the width of an opening relative to the width of a chamber (as measured between two legs of crosses) is approximately 0.2 and according to one embodiment the ratio is between 0.1 and 0.3.

According to the preferred embodiment the mat as shown in FIG. 1 is made from a flexible woven material which is formed by connecting the side faces 51,52 of the upper and lower surfaces of the mat together. Although the central area of the mat has properly defined chambers and crosses around the periphery of the mat, the chambers and crosses zones are only partly formed.

The mat has an opening connected to one of the chambers and when ready for use is filled with a wet concrete which is pumped throughout the mat. The opposing surfaces of the mat then expand to receive the concrete in each of the chambers. The approximate height of the chambers when filled with concrete is 12 cm.

The mat when filled with concrete has the appearance of an airbed.

As the concrete in the mat dries fractures occur across the concrete bridging the openings. If the mat is moved the concrete in each of the chambers can effectively move with respect to the concrete in an adjacent chamber because the concrete in one of those chambers is effectively separated from the concrete in an adjacent chamber by virtue of the fracture occurring across the bridging opening 32. As shown in FIG. 2 the opening is defined by opposing ends of legs of adjacent crosses. These ends are formed by converging sides 23 and 24 which form an apex 18. These apexes 18 are aligned with a central longitudinal axis 53 extending down the line of the legs 14 and through the associated central portions 16.

Preferably each apex 18 which is formed on the end of its associated leg has an internal angle of between 0° and 180° formed by adjacent sides 23 and 24.

Optionally the apexes 18 are offset from the central longitudinal axis 53.

Preferably the serrations 33, 34 on respective sides of each apex 18 are symmetrically aligned with those of an opposing apex 18 about a dividing line 35 located midway across the opening 32 and perpendicular to the central longitudinal axis 53 of each leg 14.

According to one embodiment each serration 34, 33 has an angle of between 0° and 180°. Preferably this angle is between 180° and 90°.

According to one embodiment the serrations 34, 33 are arcuate rather than pointed.

According to another embodiment serrations 33 and 34 at the end of each leg 14 are the only serrations on each leg 14 and instead each leg 14 is a rectangular elongate portion with a pointed end.

Preferably the width across each leg 14 from one serration 34 to an opposing serration 33 is 6 cm and the distance across the narrowest part of each leg 14 (that is between the bottom of the recess formed between two serrations is 3 cm.

THE WEAVING SPECIFICATIONS

According to the preferred embodiment the mat is formed from a fabric which is a continuous filament of polyester. The specific characteristics of this fibre when woven for the mat are as follows:

| | | |
|---|---|---|
| Warp & Weft | 1100 DTX High Tenacity, Heavily U.V. stabilised, continuous filament Polyester | |
| Ends/Pick | 18.3/15.5 per cm | |
| Fabric Weight | 400 G/M2 | |
| Grab Tensile Strength | Warp above 2800N per 50 mm per fabric layer | |
| ASTM - D 1682 - 75 | Weft above 2400N per 50 mm per fabric layer | |
| Grab Elongation at break | Warp 25% | |
| ASTMD - 1682 - 75 | Weft 25% | |
| Tear Strength | Warp above 1100N per fabric layer | |
| ASTMD - 1117 - 80 | Weft above 1100N per fabric layer | |
| Porosity | 850–1000 cub cm/min/sq cm | |
| ASTM - D - 737 - 75 | | |
| Burst Strength | Above 2300N | |
| ASTMD - 3786 - 80 | | |
| Puncture Strength | Above 1100N | |
| ASTMD - 3784 - 80 | Per single layer of fabric | |
| Water Flow Rate | 85–125 cub cm/min/sq cm | |
| ASTMD - 4491 | | |
| Mill Width | Piece Length | Piece Weight |
| 270 cm | 100 m | 110 kg |

The crosses which are woven into the mat are prepared by setting the weaving apparatus according to a dot diagram. For the preferred embodiment the dot diagram is enclosed as an appendix 1.

As shown in the appendix, the black and white areas of the diagrams show how the interlacing of yarns is arranged in order to produce the required revetment fabric. The diagrams shown are called peg plans.

Each black square indicates one end of yarn travelling lengthwise along the fabric, passing over yarn travelling across the fabric. The blank squares indicate the ends going under these yarns crossing the fabric. For example, the attached plan shows the first black mark going up the page, it passes over three yarns and under one and so on. The next column shows the black mark (or yarn end) going under two yarns, then over one and so on up the page.

When all these yarns are interlacing in a predetermined manner, the pattern is formed. There are sixteen different interlacings as shown at the bottom of the plan.

The above is technology that is well understood by persons skilled in weaving technology and reference is made to the common general knowledge in the weaving field.

I claim:

1. A body having an interior with a plurality of chambers, the improvement wherein the body comprises a plurality of fracture zones which are adapted to create fractures in a settable substance as it hardens inside the body and a plurality of filter zones which permit water to pass through opposing exterior surfaces of the body.

2. A body as claimed in claim 1 wherein each fracture zone comprises an opening interconnecting adjacent chambers.

3. A body as claimed in claim 2 wherein the openings have side barrier portions with respective end portions arranged opposite each other.

4. A body as claimed in claim 3 wherein each end portion includes adjacent straight sides which meet at an apex.

5. A body as claimed in claim 2 wherein each side barrier portion comprises adjacent straight walls which meet at an apex.

6. A body as claimed in claim 5 comprising a flexible material.

7. A body as claimed in claim 6 wherein the flexible material comprises a woven fabric.

8. A body as claimed in claim 1 wherein the fracture zones create fractures in the settable substance which is arranged to be pumped into the interior of the body, and as a result of the fractures curing creates hardened substance portions in each chamber.

9. A body as claimed in claim 8 wherein the substance portions created in adjacent chambers are moveable with respect to each other.

10. A body as claimed in claim 1 wherein the fractures which are created in the substance enable the body to be flexible or bendable so that it may be reconfigured to different shapes.

11. A body having an interior with a plurality of chambers, the improvement wherein the body comprises a plurality of fracture zones which are adapted to create fractures in a settable substance as it hardens inside the body and a plurality of filter zones which permit water to pass through opposing exterior surfaces of the body, and wherein each chamber is defined by a plurality of boundary portions with each fracture zone comprising an opening between opposing end portions of different boundary portions.

12. A body as claimed in claim 11, wherein each chamber comprises boundary portions which substantially surround an interior portion of the chamber.

13. A body as claimed in claim 11, wherein the boundary portions form respective corners of the interior of each chamber.

14. A body as claimed in claim 13 wherein the chamber is rectangular in shape with the openings in side walls formed by adjacent boundary portions.

15. A body as claimed in claim 14 wherein each boundary portion comprises four radiating portions.

16. A body as claimed in claim 15 wherein each boundary portion includes a straight section.

17. A body as claimed in claim 13 wherein each chamber comprises four openings.

18. A body as claimed in claim 17, wherein each opening is formed substantially midway along each side wall.

19. A body as claimed in claim 11 wherein each boundary portion comprises a central portion with a plurality of radiating portions extending radially therefrom.

20. A body as claimed in claim 19 wherein each boundary portion comprises four radiating portions at substantially 90° with respect to each other.

21. A body as claimed in claim 19 wherein the opposing end portions of boundary portions are symmetrical about a centre line through the opening between the opposing end portions.

22. A body as claimed in claim 11 wherein each boundary portion has serrated sides.

23. A body as claimed in claim 22, wherein each boundary portion has an end portion which is co-linear with the end portion of another boundary portion separated therefrom by at least one opening.

24. A body as claimed in claim 23 wherein the shortest distance across an opening is measured between the apex of opposing end portions of separate boundary portions.

25. A body as claimed in claim 23 wherein each radiating portion comprises lateral portions arranged symmetrically along a central axis of the radiating portion.

26. A body as claimed in claim 22 wherein each end portion comprises side portions which converge to an apex.

* * * * *